US006189865B1

(12) United States Patent
Ruffie et al.

(10) Patent No.: US 6,189,865 B1
(45) Date of Patent: Feb. 20, 2001

(54) JACK FOR LIFTING A VEHICLE

(75) Inventors: Gilles Ruffie, Boynes; David Framboisier, Orléans, both of (FR)

(73) Assignee: Adwest Bowden Frances S.A. (FR)

( * ) Notice: Under 35 U.S.C. 154(b), the term of this patent shall be extended for 0 days.

(21) Appl. No.: 09/355,366

(22) PCT Filed: Jan. 23, 1998

(86) PCT No.: PCT/FR98/00120

§ 371 Date: Oct. 5, 1999

§ 102(e) Date: Oct. 5, 1999

(87) PCT Pub. No.: WO98/32688

PCT Pub. Date: Jul. 30, 1998

(30) Foreign Application Priority Data

Jan. 24, 1997 (FR) ..... 97 99775

(51) Int. Cl.[7] ..... B66F 3/00
(52) U.S. Cl. ..... 254/126; 254/124; 254/DIG. 1
(58) Field of Search ..... 254/126, 124, 254/DIG. 1

(56) References Cited

U.S. PATENT DOCUMENTS 3,746,307 * 7/1973 Yamazaki ..... 254/126
4,720,081 * 1/1988 Exner ..... 254/126
5,118,083 * 6/1992 Metzen ..... 254/126
5,275,378 * 1/1994 Alten ..... 254/126
5,988,594 * 11/1999 Gill ..... 254/126
6,022,001 * 2/2000 Palacio et al. ..... 254/126

* cited by examiner

*Primary Examiner*—Stephen F. Gerrity
*Assistant Examiner*—Lee Wilson
(74) *Attorney, Agent, or Firm*—Blakely Sokoloff Taylor & Zafman

(57) ABSTRACT

The invention relates to a jack, the jack comprises a base for placing on the ground and an elevator mechanism which bears against the base via a leg (1) linked to the base by a device so that the leg can pivot on the base about a horizontal axis X'X and can slide on the base along the axis, the jack being characterized in that the base (5) has a longitudinal rig (5*b*) with a rounded top projecting above the base, the rib defining the axis, the leg (1) is provided at its bottom end with a slide (8) made of a block of synthetic organic material engaged in the bottom end and held to the leg by a device, the slide being shaped so as to be capable of fitting astride the rib of the base with the ability to pivot on the rib about the axis and to slide along the rib, and a link device (9, 10, 12) is established between the leg and the base to hold the slide on the rib. The invention applies in particular to a jack for lifting a vehicle.

20 Claims, 6 Drawing Sheets

JACK FOR LIFTING A VEHICLE

The invention relates to a jack for lifting a vehicle, the jack comprising a base for placing on the ground and an elevator mechanism which bears against the base via a leg, the leg being linked to the base by a device so that the leg can pivot on the base about a horizontal axis and can slide on the base along the horizontal axis.

BACKGROUND

The ability of the elevator device to slide longitudinally and to pivot relative to the base limits parasitic forces tending to twist the jack while the vehicle is being raised.

An embodiment of such a jack is described, for example, in publication DE-U-8 702 290.

The present invention provides a jack that is simpler to manufacture.

SUMMARY

The jack of the invention is characterized in that:

the base has a longitudinal rig with a rounded top projecting above the base, the rib defining the pivot axis;

the leg is provided at its bottom end with a slide made of a block of synthetic organic material engaged in the bottom end and held to the leg, the slide being shaped so as to be capable of fitting astride the rib of the base with the ability to pivot on the rib about the axis and to slide along the rib; and a link device is established between the leg and the base to hold the slide on the rib.

An embodiment of a jack of the invention as defined above is described below, this embodiment also having other characteristics which form portions of the invention, in isolation or in combination.

In this embodiment, the link device has a shaft which passes through the leg and/or the slide parallel to the axis and which is attached to the base so as to be capable of pivoting about the axis.

BRIEF DESCRIPTION OF THE DRAWINGS

The description refers to the figures of the accompanying drawings, in which.

The jack shown in the figures is of the Y type.

DESCRIPTION

Figure 1:
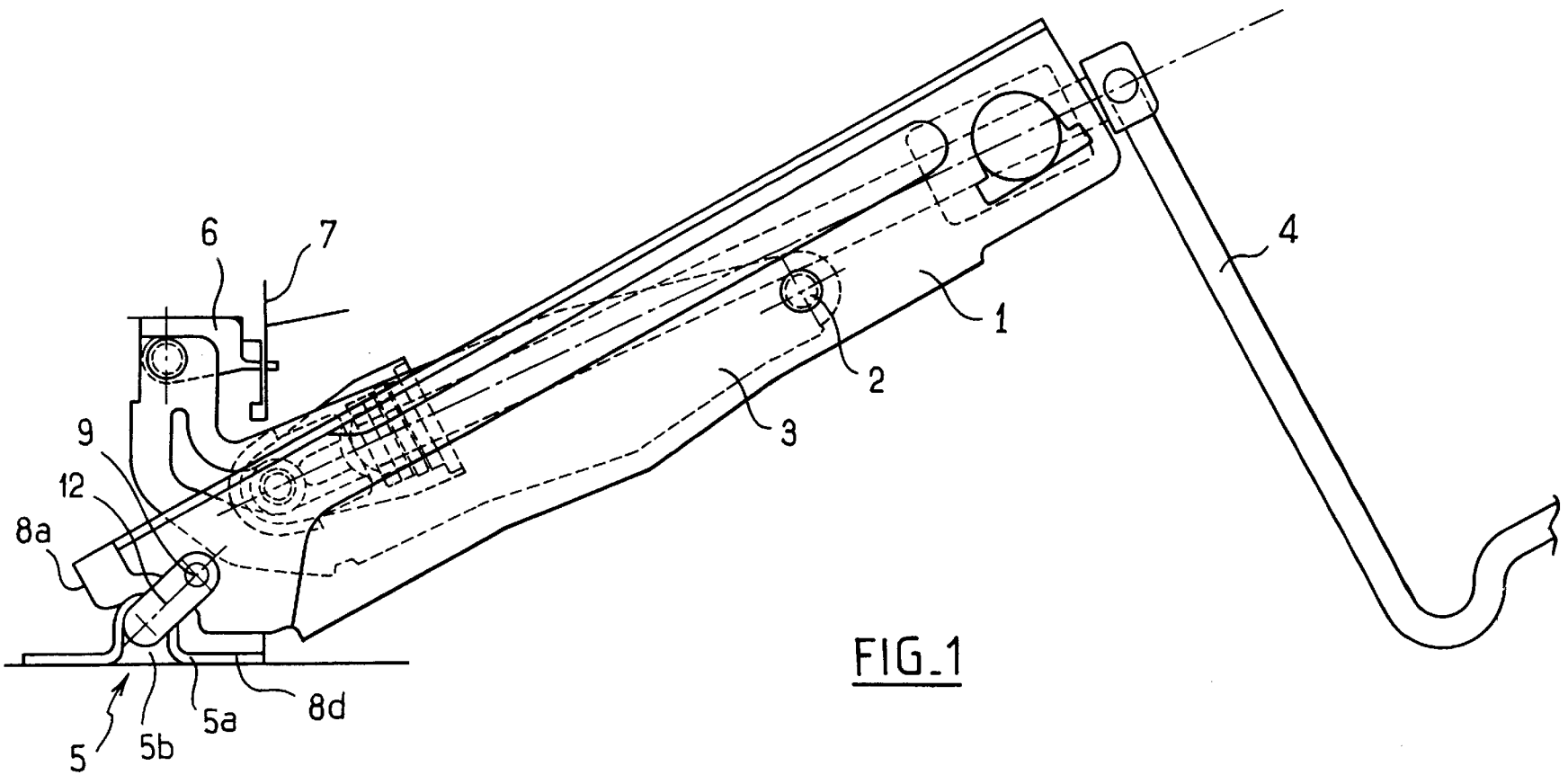
FIG. 1 is a general view of the jack in position for inserting under a car.

Essentially, and in conventional manner, the jack comprises an elevator mechanism constituted by a bearing leg 1 having an elevator leg 3 hinged thereto about an axis 2, a device being provided to enable the elevator leg to pivot about the axis under the control of a handle 4 (FIG. 1).

The bearing leg 1 bears against the ground via a base 5, and the elevator leg 3 is provided with an accessory 6 enabling it to engage the underside of a vehicle which is represented merely by a side member 7 of its bodywork (FIG. 1).

According to the invention, the base is constituted by a metal plate 5*a* which is deformed locally, e.g. in its middle, so as to constitute a longitudinal tunnel 5*b* of substantially U-shaped right section, the tunnel embodying the pivot axis X'X.

In a variant, the tunnel could be formed by a cylinder fitted to the plate, but that embodiment is less advantageous.

Figure 2:
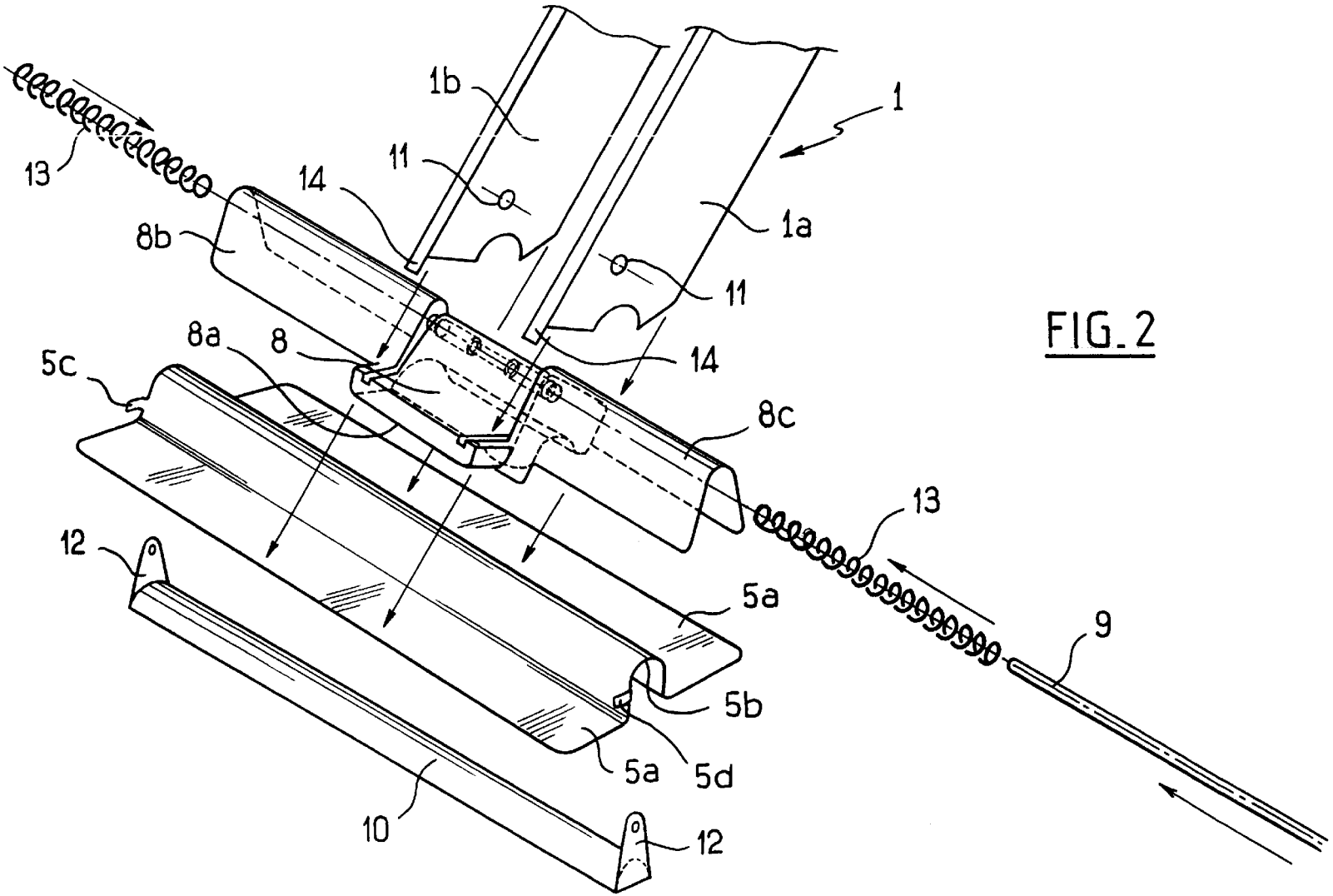
FIG. 2 is a detail view of the ground-bearing end of the jack, with the various parts provided by the invention being shown separately to clarify the figure.
Figure 3:
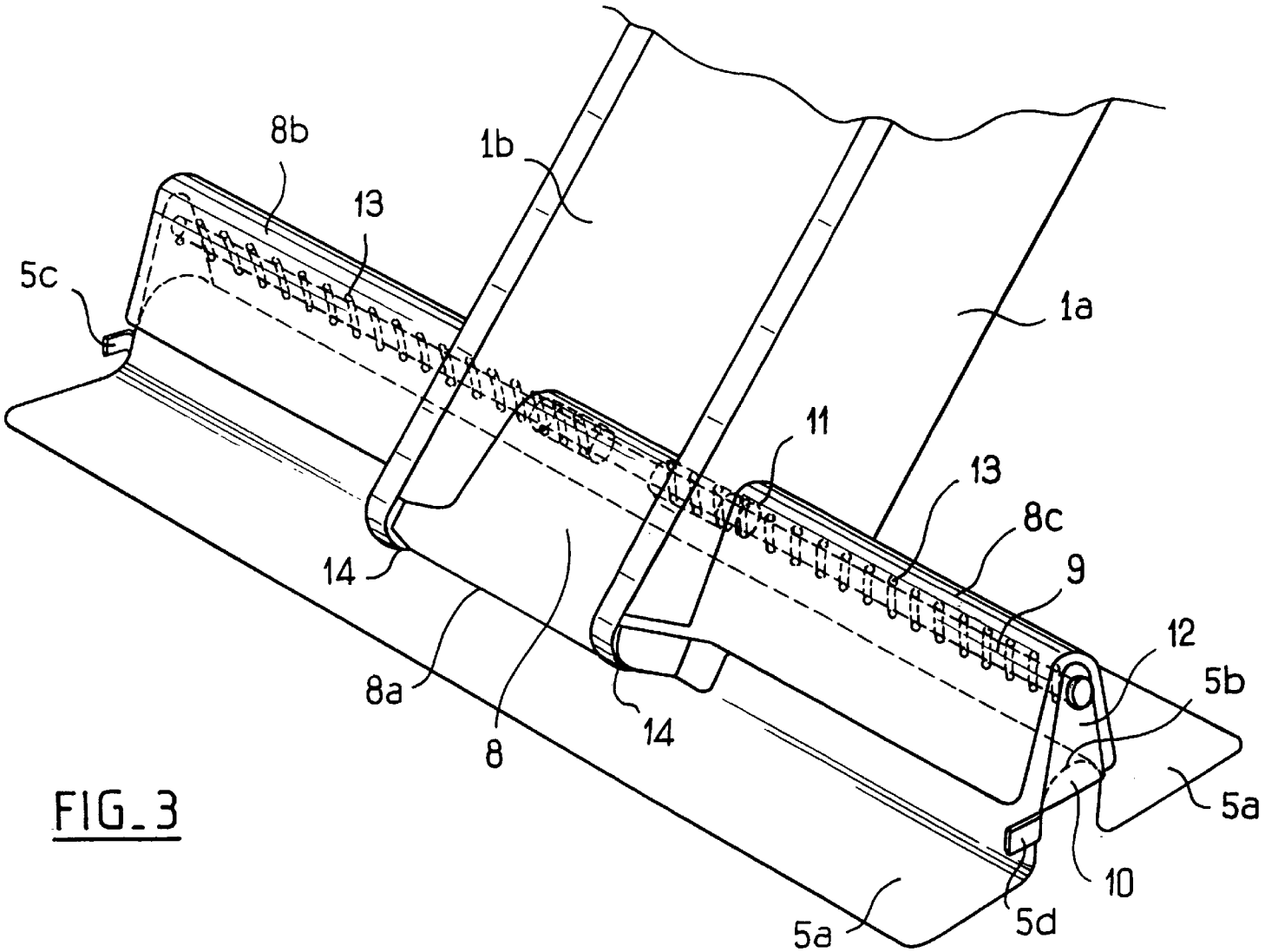
FIG. 3 is a view similar to FIG. 2 after the parts have been assembled together.
Figure 4:
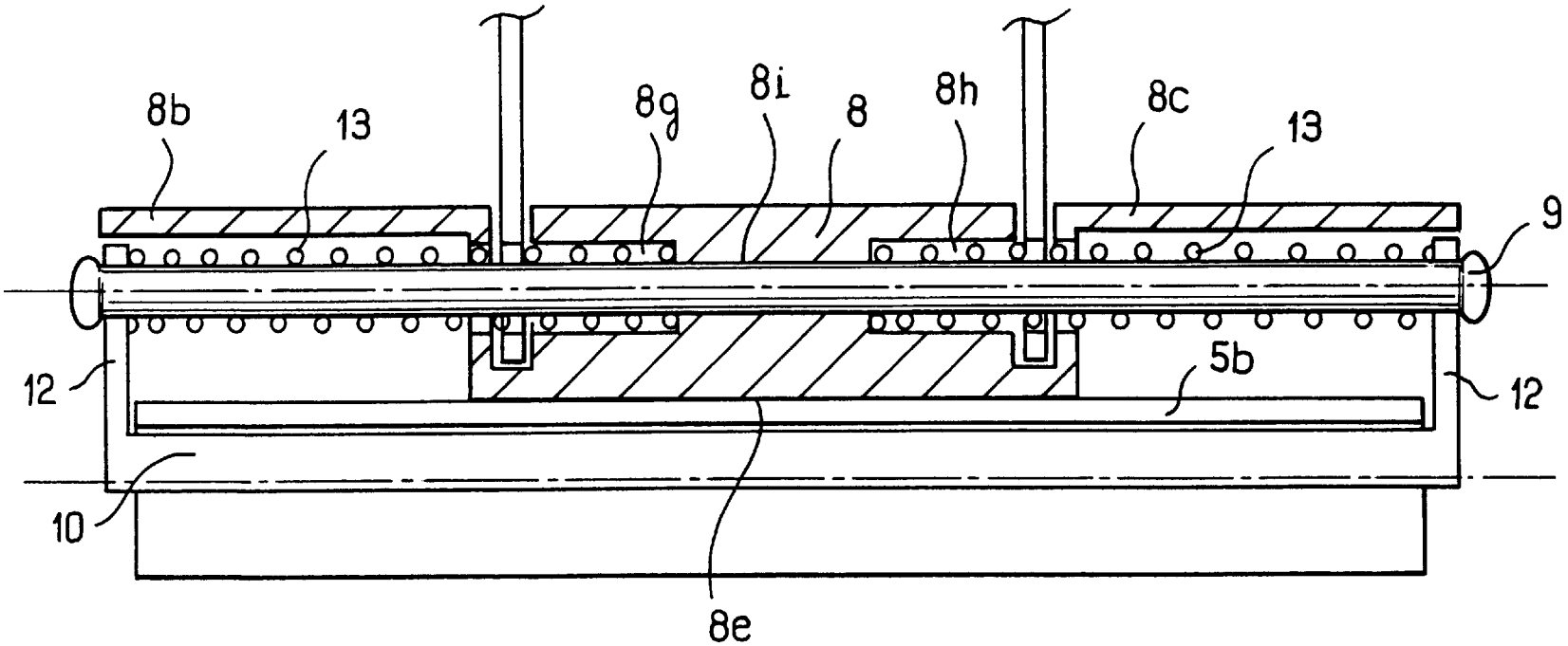
FIG. 4 is a section through the ground-bearing end of the jack on a plane AA containing the pivot axis.
Figure 5:
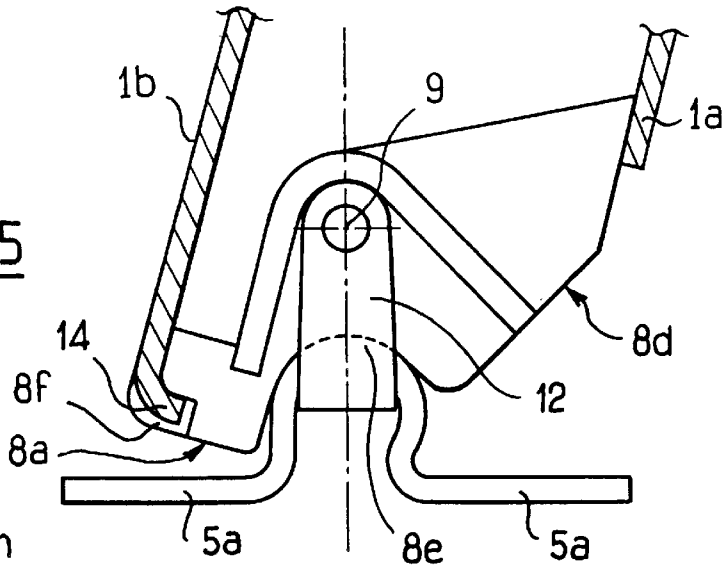
FIG. 5 is a section on a plane perpendicular to the plane AA of FIG. 4.

The bearing leg 1 has two parallel walls 1*a* and 1*b*, generally made of metal, and at the bottom end of the leg they define between them a gap in which there is engaged a block 8 made of a synthetic organic material having a good sliding coefficient and good mechanical strength, e.g. a block of polyacetal. The block is held engaged by tabs 14 formed at the ends of the walls 1*a* and 1*b* and folded around the block after it has been put into place. The tabs are shown prior to being folded in FIG. 2, and after being folded in FIGS. 3 and 5. In a variant, other fastener could be used, e.g. adhesive.

The block is shaped to have an underface 8*e* with a rounded recess (FIG. 5) for placing astride the tunnel 5*b* so as to be capable of pivoting forwards and backwards on the top of the tunnel and so as to capable of sliding along the tunnel.

Figure 7:
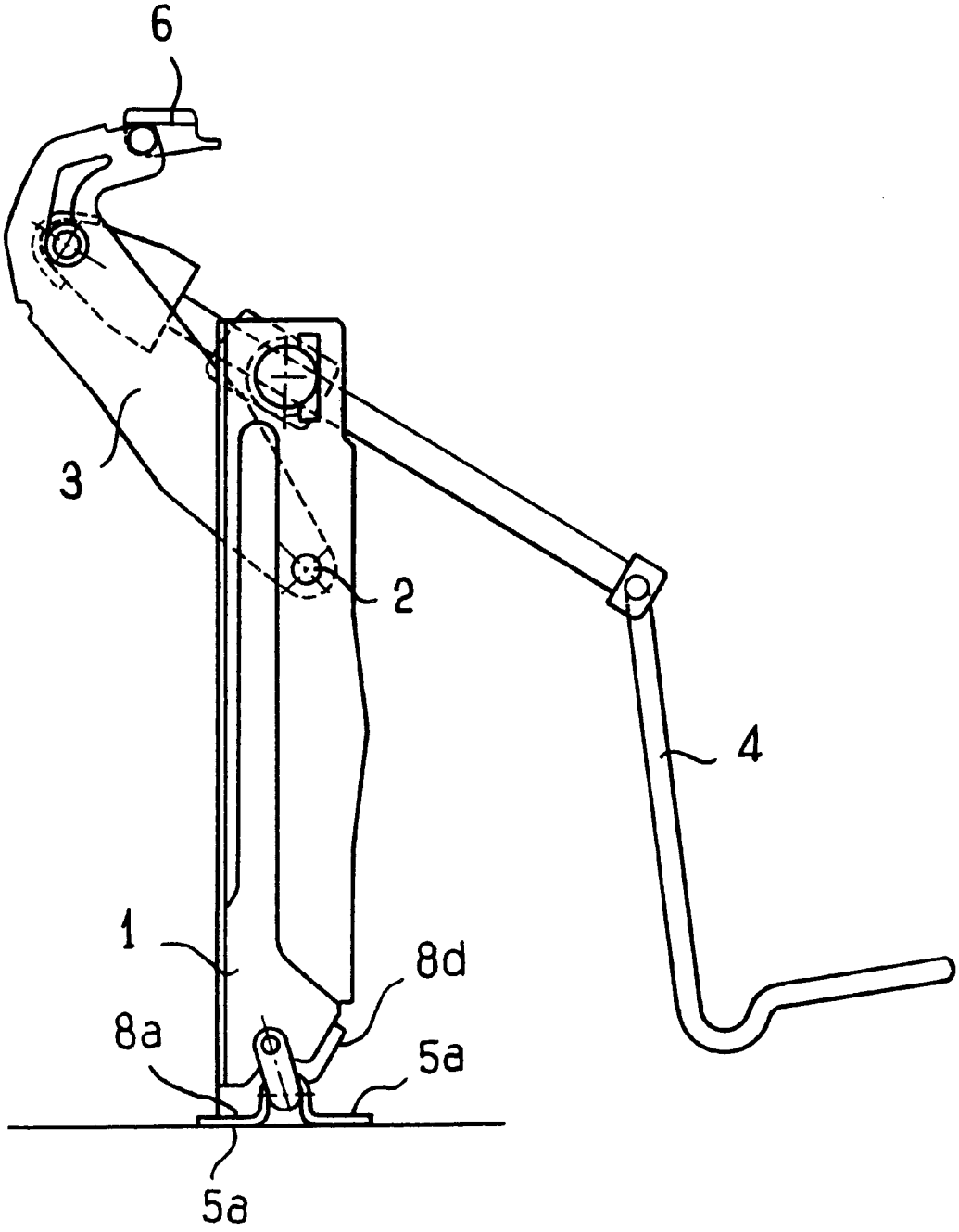
FIG. 7 is a general view of the jack pivoted into end-of-elevation stroke position.

The block has two stops 8*a* and 8*b* which limit the pivot stroke of the block (and thus of the leg) in one direction and in the other by coming into abutment against the plate 5*a* of the base (figure). The two end-of-pivot stroke positions of the leg relative to the face correspond respectively to the position in which the leg is inserted under the car (FIG. 1) and the maximum lift position where the leg is vertical (FIG. 7).

The sliding stoke on the base of the block (and thus of the leg) is defined in opposite directions by tabs 5*c* and 5*d* formed in the plate of the base in the ends of the tunnel 5*b*.

The leg is linked to the base by a link device which has two parallel shafts 9 and 10, one of the shafts, 9, passing through holes 11 formed in the walls 1*a* and 1*b* of the leg and/or passing through the block, and the other shaft 10 passing through the tunnel 5*b*, with the two shafts being interconnected by two plates 12 or by any equivalent interconnection.

It is possible for the shaft 9 to pass only through the metal flanks 1*a* and 1*b* of the leg (above the block) or to pass only through the block, however and as shown, it is preferable for the shaft to pass both through the leg and through the block, with the block serving as a bearing for the shaft.

The shaft 9 can be continuous as shown, or else it can be discontinuous. In which case, it is constituted by two shafts, e.g. respectively situated to the right and to the left of the block, and each having an end that is anchored in the block.

Similarly, the shaft 10 can be continuous or it can be constituted by two parts that are engaged in respective opposite ends of the tunnel.

The shaft 9 and the shaft 10 can have any right section.

In the example shown, the shaft 9 is cylindrical and the shaft 10 has a right section in the form of a circular sector, but these shapes are given purely by way of example.

The shaft 9 carries springs 10 which urge the leg towards a position that is situated in the middle of its sliding stroke.

The block 8 is preferably extended laterally beyond the walls 1*a* and 1*b* of the leg 1 by portions 8*b* and 8*c* which constitute covers hiding the springs 13.

Figure 6:
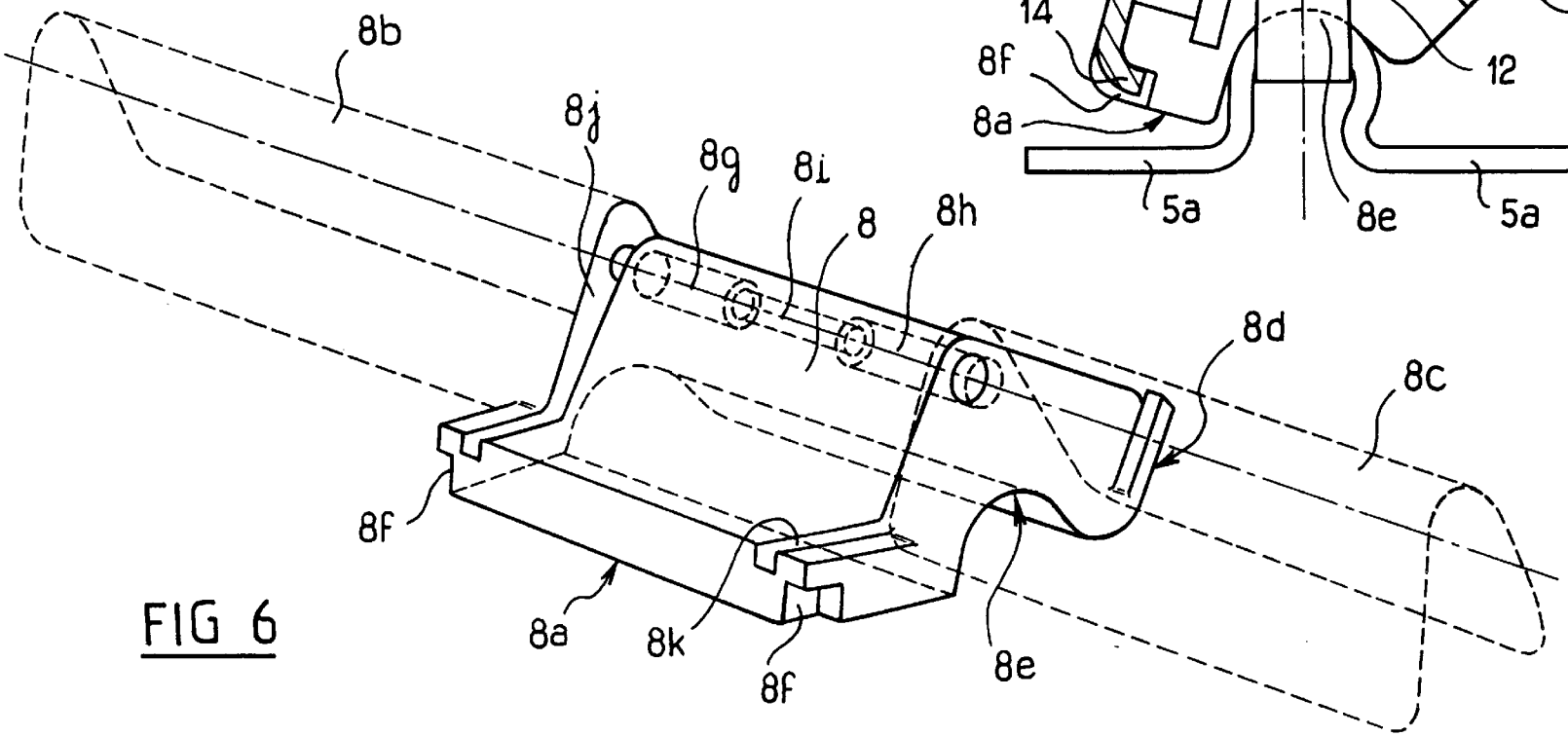
FIG. 6 is a general view of the slide.

In this embodiment, according to an important aspect of the invention, a large number of functions are performed by the block 8 of synthetic organic material, made by molding and possibly also machined. In particular, from FIG. 6 which is a view of the block on its own, it can be seen that it is in the form of a saddle having:

a re-entrant rounded surface 8*e* shaped to pivot on the rib of the base;

sloping flat longitudinal sides 8*a* and 8*d* that rise outwards to constitute the two stops which limit the pivot stroke of the leg on the base;

two notches 8*f* for receiving the folded tabs 14 of the metal flanks of the leg;

two coaxial bores 8*g* and 8*h* opening to the outside to receive the ends of the springs 13 and to allow the shaft 9 to pass through;

a central bore 8*i* interconnecting the side bores and serving as a bearing for the shaft 9; and two extensions 8*b* and 8*c* which serve as covers for hiding and protecting the springs 13. In this case, grooves 8*j* and 8*k* are formed between the central portion of the block and the covers to receive the ends of the metal flanks of the leg.

The invention is not limited to being applied to a Y-type jack nor is it limited to this particular invention described or can substitute the invention by a functionally equivalent device.

What is claimed is:

1. A jack for lifting a vehicle, the jack comprising a base for placing on the ground and an elevator mechanism which bears against the base via a leg (1) linked to the base by a device so that said leg can pivot on the base about a horizontal axis X'X and can slide on the base along said axis, the jack being characterized in that:

the base (5) has a longitudinal rig (5*b*) with a rounded top projecting above the base, said rib defining said axis;

said leg (1) is provided at its bottom end with a slide (8) made of a block of synthetic organic material engaged in said end and held to the leg by said device, the slide being shaped so as to be capable of fitting astride the rib of the base with the ability to pivot on the rib about said axis and to slide along the rib; and a link device (9, 10, 12) is established between the leg and the base to hold the slide on the rib.

2. A jack according to claim 1, in which the base is constituted by a plate (5*a*) which has been locally deformed to constitute a longitudinal tunnel (5*b*) of substantially U-shaped right section on one face of the plate, said tunnel constituting said rib.

3. A jack according to claim 2 in which said plate has cutout portions (5*c*, 5*d*) constituting tabs defining end-of-stroke abutments for sliding of the leg.

4. A jack according to claim 3, in which said link device comprises a continuous or discontinuous shaft (10) in the tunnel of the base, and connected at its ends to a continuous or discontinuous parallel shaft (9) which passes through the leg and/or the slide.

5. A jack according to claim 2, in which the leg (1) has tabs (14) which are folded over the slide to hold it fixed to the leg.

6. A jack according to claim 2, in which said link device comprises a shaft (9) passing through the leg and/or the slide parallel to said axis and which is attached to the base so as to be capable of pivoting about said axis.

7. A jack according to claim 6, in which said shaft (9) carries springs (13) tending to return the leg towards a position in which the leg is substantially in the middle of its sliding stroke.

8. A jack according to claim 7, in which the slide (8) has extensions (8*b*, 8*c*) outside the leg forming covers for hiding said springs.

9. A jack according to claim 2, in which said link device comprises a continuous or discontinuous shaft (10) in the tunnel of the base, and connected at its ends to a continuous or discontinuous parallel shaft (9) which passes through the leg and/or the slide.

10. A jack according to claim 2, in which said block has two walls (8*a*, 8*b*) constituting stops suitable for coming into abutment against the base to define the pivot stroke of the leg on the base.

11. A jack according to claim 2, and in which said block (8) is in the form of a saddle having a rounded and recessed surface (8*e*) for pivoting on the rib (5*b*) of the base, and two longitudinal sides (8*a*, 8*d*) which rise outwardly to cooperate with the base (5*a*) by coming into contact therewith to define the pivot stroke of the leg on the base.

12. A jack according to claim 11, in which the block has two bores (8*g*, 8*h*) in alignment that open to the outside of the block to receive the ends of two springs (13) and interconnected by a central bore (8*i*) serving as a bearing for a shaft (9) which passes through the aligned bores and which carries the springs.

13. A jack according to claim 1, in which the leg (1) has tabs (14) which are folded over the slide to hold it fixed to the leg.

14. A jack according to claim 1, in which said link device comprises a shaft (9) passing through the leg and/or the slide parallel to said axis and which is attached to the base so as to be capable of pivoting about said axis.

15. A jack according to claim 14, in which said shaft (9) carries springs (13) tending to return the leg towards a position in which the leg is substantially in the middle of its sliding stroke.

16. A jack according to claim 15, in which the slide (8) has extensions (8*b*, 8*c*) outside the leg forming covers for hiding said springs.

17. A jack according to claim 1, in which said link device comprises a continuous or discontinuous shaft (10) in the tunnel of the base, and connected at its ends to a continuous or discontinuous parallel shaft (9) which passes through the leg and/or the slide.

18. A jack according to claim 1, in which said block has two walls (8*a*, 8*b*) constituting stops suitable for coming into abutment against the base to define the pivot stroke of the leg on the base.

19. A jack according to claim 1, and in which said block (8) is in the form of a saddle having a rounded and recessed surface (8*e*) for pivoting on the rib (5*b*) of the base, and two longitudinal sides (8*a*, 8*d*) which rise outwardly to cooperate with the base (5*a*) by coming into contact therewith to define the pivot stroke of the leg on the base.

20. A jack according to claim 19, in which the block has two bores (8*g*, 8*h*) in alignment that open to the outside of the block to receive the ends of two springs (13) and interconnected by a central bore (8*i*) serving as a bearing for a shaft (9) which passes through the aligned bores and which carries the springs.

* * * * *

UNITED STATES PATENT AND TRADEMARK OFFICE

CERTIFICATE OF CORRECTION

PATENT NO. : 6,189,865 B1 
DATED : February 20, 2001
INVENTOR(S) : Ruffie et al.

It is certified that error appears in the above-identified patent and that said Letters Patent is hereby corrected as shown below:

Title page,
Item [30], Foreign Application Priority Data, delete "99775" and insert -- 00775 --.

Signed and Sealed this

Twenty-first Day of January, 2003

JAMES E. ROGAN
*Director of the United States Patent and Trademark Office*